US006311920B1

(12) United States Patent
Jennings et al.

(10) Patent No.: US 6,311,920 B1
(45) Date of Patent: Nov. 6, 2001

(54) PRECISION WINDING METHOD AND APPARATUS

(75) Inventors: Uel Duane Jennings, Signal Mountain; Jesse Alexander Batten, Harrison; Kenneth Marvin Dean, II, Chattanooga; Michael Stanley Chastain, Ooltewah; Duane Clifford Soule, Collegedale, all of TN (US)

(73) Assignee: TB Wood's Enterprises, Inc., Chambersburg, PA (US)

( * ) Notice: Subject to any disclaimer, the term of this patent is extended or adjusted under 35 U.S.C. 154(b) by 0 days.

(21) Appl. No.: 09/355,713

(22) PCT Filed: Feb. 3, 1998

(86) PCT No.: PCT/US98/02275

§ 371 Date: Aug. 3, 1999

§ 102(e) Date: Aug. 3, 1999

(87) PCT Pub. No.: WO98/33735

PCT Pub. Date: Aug. 6, 1998

Related U.S. Application Data

(60) Provisional application No. 60/037,821, filed on Feb. 5, 1997.

(51) Int. Cl.[7] ..... B65H 54/38
(52) U.S. Cl. ..... 242/477.6
(58) Field of Search ..... 242/477.4, 477.6

(56) References Cited

U.S. PATENT DOCUMENTS

| | | | | |
|---|---|---|---|---|
| 2,600,256 | | 6/1952 | Morrison et al. . | |
| 4,049,211 | * | 9/1977 | Spescha | 242/477.4 X |
| 4,059,239 | | 11/1977 | Hori et al. . | |
| 4,307,848 | | 12/1981 | Barathieu . | |
| 4,325,517 | | 4/1982 | Schippers et al. . | |
| 4,327,873 | | 5/1982 | Juppet et al. . | |
| 4,484,435 | | 11/1984 | Fritjof . | |
| 4,487,374 | | 12/1984 | Sugioka et al. . | |
| 4,494,702 | | 1/1985 | Miyake et al. . | |
| 4,504,021 | | 3/1985 | Schippers et al. . | |
| 4,504,024 | | 3/1985 | Gerhartz . | |
| 4,667,889 | * | 5/1987 | Gerhartz | 242/477.6 |
| 4,676,441 | | 6/1987 | Maag . | |
| 4,697,753 | * | 10/1987 | Schippers et al. | 242/477.6 |
| 4,771,961 | * | 9/1988 | Sugioka | 242/477.4 |
| 4,779,813 | * | 10/1988 | Sugioka et al. | 242/477.4 |
| 4,789,107 | | 12/1988 | Hauser et al. . | |
| 4,854,510 | | 8/1989 | Romanin et al. . | |
| 4,854,511 | | 8/1989 | Montali et al. . | |
| 4,854,512 | | 8/1989 | Montali et al. . | |
| 4,911,370 | | 3/1990 | Schippers et al. . | |
| 4,913,363 | | 4/1990 | Lenz . | |
| 4,986,483 | | 1/1991 | Ryu et al. . | |
| 4,989,798 | | 2/1991 | Nickell . | |
| 4,993,650 | | 2/1991 | Nickell . | |
| 5,035,369 | | 7/1991 | Beran et al. . | |
| 5,056,724 | * | 10/1991 | Prodi et al. | 242/477.6 |
| 5,170,952 | | 12/1992 | Kamp et al. . | |
| 5,288,031 | | 2/1994 | Linderoth . | |
| 5,439,184 | | 8/1995 | Pöppinghaus et al. . | |
| 5,447,277 | * | 9/1995 | Schlüter et al. | 242/477.6 |
| 5,605,295 | | 2/1997 | Klee . | |

* cited by examiner

*Primary Examiner*—Michael R. Mansen
(74) *Attorney, Agent, or Firm*—Webb Ziesenheim Logsdon Orkin & Hanson, P.C.

(57) ABSTRACT

A method and apparatus for step precision winding yarn into a package (P). During winding, the traverse frequency is adjusted so that a first actual winding ratio parallels adjacent a first integer winding ratio. When the rotational velocity of the package decreases sufficiently, the traverse frequency is step increased so that the first actual winding ratio step decreases to the second actual winding ratio adjacent a second integer winding ratio. A ratio between the first actual winding ratio and the first integer winding ratio defines an integer offset ratio and a ratio between the second actual winding ratio and the second integer winding ratio corresponds to the integer offset ratio.

20 Claims, 9 Drawing Sheets

PRECISION WINDING METHOD AND APPARATUS

This application claims benefit to No. 60/037,821 filed Feb. 5, 1997.

BACKGROUND OF THE INVENTION

1. Field of the Invention

The present invention relates to winding lengths of material on a package.

2. Description of the Prior Art

Precision wound packages of lengths of materials, such as textile yarns, are well known in the art and have been used as the industry standard because of their uniform over-end take-off tension during removal of the length of material and due to their attractive high quality appearance which is unique to precision wound packages. Precision wound packages are so named because the length of material is traversed in a precise pattern across the package as the package rotates and winds the length of material thereon. This pattern avoids one wrap of the length of material from being overlaid on an adjacent wrap of the length of material in a given helical band of the package P. Such overlay, which is common in cross-wound (non-precision wound) packages, produces poor material take-off tension uniformity and can also cause "bumps" which result in vibration during rotation of the package.

Lengths of material that need to be wound at a constant or nearly constant speed are precision wound at low material speeds because of the inherently higher helix angle utilized at the beginning of winding the package than at the end. As used herein "helix angle" is the angle between a lengthwise axis of the length of material being supplied to the package and a plane perpendicular to a lengthwise axis of the package. At a constant, or nearly constant yarn speed the higher helix angle at the beginning of winding the package requires the length of material M to be traversed at a higher traverse frequency at the beginning of winding the package than the traverse frequency at the end of winding the package P. At high winding speeds however, the required traverse frequency may be mechanically unattainable at the beginning of winding the package or may result in an unacceptably low helix angle at the end of winding the package.

U.S. Pat. No. 4,049,211 to Spescha discloses a winding apparatus wherein the actual winding ratio step decreases with increasing diameter of the package, e.g., see FIG. 3 of the Spescha patent. The Spescha patent, however, discloses that each step in actual winding ratio is at least two integer steps. Moreover, the Spescha patent discloses that a ratio of actual winding ratio to integer winding ratio closest adjacent the actual winding ratio during winding, hereinafter "integer offset ratio", varies for the different values of actual winding ratio utilized during winding of the package. It is believed that utilizing different integer offset ratios during winding produces differences in spacing between centers of adjacent wraps of the length of material wound at different actual winding ratios.

It is therefore an object of the present invention to overcome these problems and others by providing a method and apparatus for winding packages with the appearance and take-off performance of precision wound packages while avoiding unacceptably high or low traverse speeds at the beginning and end of the package, respectively. It is an object of the present invention to provide a method and apparatus for winding a package, wherein the actual winding ratio is step decreased during the winding of the package and the integer offset ratio is constant throughout the winding of the package. It is an object of the present invention to provide a method and apparatus for winding a package wherein the actual winding ratio step decreases during the winding of the package between adjacent an integer winding ratio and adjacent a sub-integer winding ratio in a manner whereby a ratio of the actual winding ratio to sub-integer winding ratio closely adjacent the actual winding ratio, hereinafter "sub-integer offset ratio" is constant during winding of the package and the integer winding ratio is constant throughout winding of the package.

SUMMARY OF THE INVENTION

Accordingly, we have invented a method of precision winding a package. The method includes supplying a continuous length of material to a bobbin having a lengthwise axis. The bobbin is rotated around the lengthwise axis and the supplied continuous length of material is wound around the periphery of the bobbin to form a package. The supplied continuous length of material is traversed between ends of the package while winding the same therearound. The rotational velocity of the rotating package and the traverse frequency that the supplied continuous length of material traversed between ends of the package are determined. The length of material is wound on the package at a first actual winding ratio adjacent a first integer winding ratio. The traverse frequency is decreased in response to decreasing rotational velocity of the package so that the first actual winding ratio parallels adjacent the first integer winding ratio. The traverse frequency is step increased so that the first actual winding ratio step decreases to a second actual winding ratio adjacent a second integer winding ratio. Each actual winding ratio corresponds to a ratio of the determined rotational velocity of the package to the determined traverse frequency. A ratio of the first actual winding ratio and the adjacent first integer winding ratio defines an integer offset ratio and a ratio of the second actual winding ratio on the second integer winding ratio corresponds to the integer offset ratio.

The integer offset ratio is constant during winding of the package for each actual winding ratio that parallels adjacent an integer winding ratio with decreasing rotational velocity of the package.

The method can include step increasing the traverse frequency whereby the first actual winding ratio step decreases to an actual winding ratio adjacent a sub-integer winding ratio between the first integer winding ratio and the second integer winding ratio. The traverse frequency is decreased in response to decreasing rotational velocity of the package whereby the actual winding ratio parallels adjacent the subinteger winding ratio. The traverse frequency is step increased whereby the actual winding ratio paralleling adjacent the sub-integer winding ratio step decreases to the second integer winding ratio. A ratio of the actual winding ratio and the sub-integer winding ratio adjacent thereto corresponds to a sub-integer offset ratio. The integer offset ratio and the sub-integer offset ratio are different.

We have also invented a winding apparatus for winding a length of material. The apparatus includes a package drive connected to rotatably drive around a lengthwise axis, a package positioned to receive a length of material therearound. A cam is positioned adjacent the package and a cam drive is connected rotatably to drive the cam. The cam drive and the cam coact to reciprocatingly traverse the length of material between ends of the package when receiving the length of material therearound. A package tachometer and a cam tachometer detect the rotational velocity of the package and the cam, respectively, and provide output signals indicative thereof. A controller is connected to receive the output signals from the package tachometer and the cam tachometer and is connected to the cam drive for controlling the rotational velocity thereof so that the traverse frequency of the length of material between the ends of the package is controlled as a function of the rotational velocity of the package. The length of material is wound on the package at a first actual winding ratio adjacent a first integer winding ratio. In response to decreasing rotational velocity of the package, the traverse frequency is decreased whereby the first actual winding ratio parallels adjacent the first integer winding ratio. The traverse frequency is step increased whereby the first actual winding ratio step decreases to a second actual winding ratio adjacent a second integer winding ratio. Each actual winding ratio corresponds to a ratio of the detected rotational velocity of the package to the detected rotational velocity of the cam. A ratio of the first actual winding ratio and the adjacent first integer winding ratio defines an integer offset ratio and a ratio of the second actual winding ratio and the second integer winding ratio corresponds to the integer offset ratio.

Before winding the length of material on the package at the first integer winding ratio the length of material may be wound on the package at an actual winding ratio adjacent a suainteger winding. In response to decreasing rotational velocity of the package as the length of material is wound thereon, the traverse frequency is decreased whereby the actual winding ratio parallels adjacent the sub-integer winding ratio. The traverse frequency is step increased whereby the actual winding ratio paralleling adjacent the sub-integer winding ratio step decreases to the first actual winding ratio. A ratio of the actual winding ratio and the sub-integer winding ratio adjacent thereto corresponds to a sub-integer offset ratio. The integer offset ratio and the sub-integer ratio are different.

The rotational velocity of the cam drive is controlled so that between step increases in the traverse frequency the actal winding ratio avoids integer winding ratios and sub-integer winding ratios. During step increases in the traverse frequency, the actual winding ratio momentarily corresponds to an integer winding ratio or a sub-integer winding ratio.

A guide is connected to the cam which reciprocatingly moves the guide between the ends of the package. The guide directs the length of material to the package and the guide and the cam cooperate to cause the length of material to reciprocatingly traverse between ends of the package when receiving the length of material therearound. The guide preferably includes a slot positioned at an end of the guide opposite the cam. The slot receives the length of material therethrough.

DESCRIPTION OF THE PREFERRED EMBODIMENT

Figure 1:
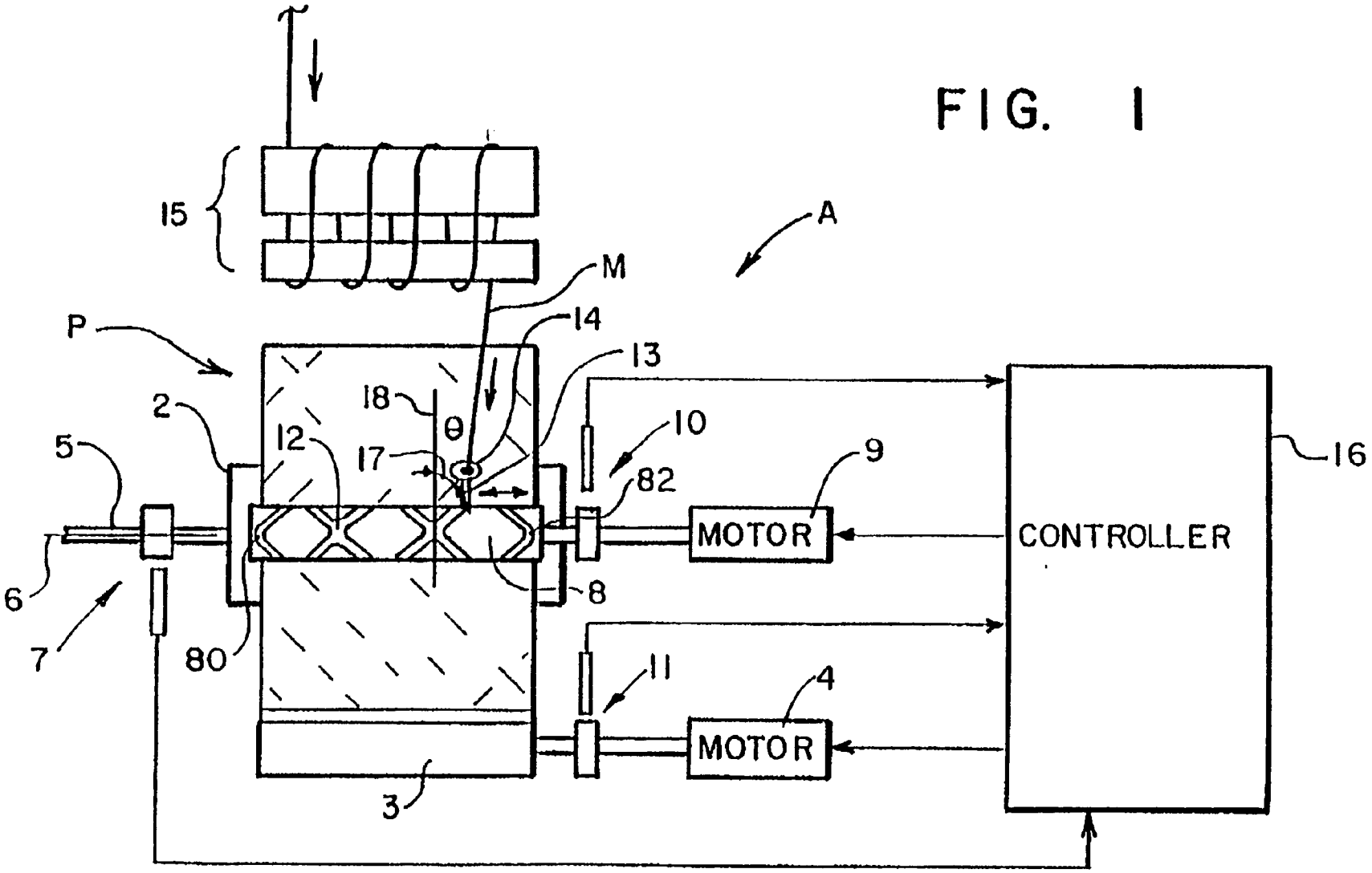
FIG. 1 is a diagrammatic representation of a winding apparatus according to the present invention.

With reference to FIG. 1, a winding apparatus A includes a bobbin 2 positioned to receive a length of material M therearound thereby forming a package P. A friction roller 3 frictionally engages the periphery of the package P and a package drive motor 4 rotatably drives the friction roller 3 to cause the package P to rotate around a shaft 5, preferably positioned coaxially with a lengthwise axis 6 of the package P. A package tachometer 7 is connected to detect the rotational velocity or RPM of the package P in response to being driven by the friction roller 3. Positioned adjacent the package P is a cam 8 which is rotatably driven by a cam motor 9. A cam tachometer 10 is connected to measure the rotational velocity or RPM of the cam 8 and a friction roller tachometer 11 is connected to measure the rotational velocity or RPM of the friction roller 3. The tachometers 7, 10 and 11 each provides an output signal indicative of the rotational velocity detected thereby.

Alternatively, the package drive motor 4 is mechanically coupled to the shaft 5, and the bobbin 2 and the shaft 5 are secured together so that the package drive motor 4 can impart to shaft 5 rotational energy which causes the package P to rotate around its lengthwise axis 6. Examples of such mechanical couplings include a coupler for connecting the package drive motor 4 and the shaft 5 in direct drive relationship, a continuous belt extending between a shaft (not shown) of the package drive motor 4 and the shaft 5 or a gear unit (not shown) connected between the package drive motor 4 and the shaft 5. Moreover, if the package drive motor 4 and/or the cam motor 9 are synchronous motors, the package tachometer 7 and/or the cam tachometer 10, respectively, can be eliminated.

The cam 8 has a continuous helical groove 12 formed therein. A guide 13 positioned adjacent the cam 8 has an end slidably received in the groove 12 and a slot or eyelet 14 positioned at an end of the guide 13 opposite the end thereof received in the groove 12. The slot 14 receives the length of material M therethrough. The cam motor 9 rotatably drives the cam 8 thereby causing the guide 13, and thus the length of material M received through the slot 14, to reciprocatingly traverse between the ends of the package P. The traverse frequency that the supplied continuous length of material M is reciprocatingly traversed between the ends of the package P while winding the length of material M thereabout is determined from the rotational velocity of the cam 8 detected by the cam tachometer 10. The length of material M is supplied to the slot 14 from a source of material (not shown) via one or more tensioning rollers 15.

A controller 16 is connected to receive the output signals from the tachometers 7, 10 and 11 and to provide speed control signals to the package drive roller motor 4 and the cam motor 9.

The controller 16 utilizes the output signal from the friction roller tachometer 11 to control the tension of the length of material M wound on the package P. Specifically, the controller 16 controls the package drive motor 4 in accordance with the following equation 1:

$$\omega_f=\omega_f\text{base}=k\omega_t\ \text{base}-k\omega_t \tag{1}$$

where $\omega_f$=rotational velocity of friction roller 3;

$\omega_f$ base=average rotational velocity of friction roller 3;

$\omega_t$ base=average rotational velocity of cam 8;

$\omega_t$=instantaneous rotational velocity of cam 8; and k=a constant related to the average helix angle.

Utilizing equation 1, the controller 16 can adjust the rotational velocity of the friction roller 3 to maintain a substantially constant tension on the length of material M being wound on the package P. Specifically, in response to changing helix angle during winding, the controller 16 causes the rotational velocity of the friction roller 3, and hence the package P, to change in accordance with equation 1.

Exemplary values for the constants in equation 1 include:

$\omega_f$ base=6970

$\omega_t$ base=4800; and k=0.025.

In use of the winding a A, a continuous length of material M is supplied to the package P. The package drive motor 4 rotatably drives the friction roller 3 which frictionally engages the periphery of the package P thereby causing the package P to rotate around its lengthwise axis 6 and wind the length of material M thereon. The friction roller 3 is movably tensioned against the package P, in a manner known in the art, so that as the diameter of the package P increases in response to winding the length of material thereon, the friction roller 3 and the periphery of the package P remain in contact. Importantly, as a diameter of the package P increases in response to winding the length of material thereon, the package P RPM $\omega_p$ decreases. This decrease in package P RPM $\omega_p$ with increasing diameter of the package P is indicated in FIGS. 2–7 by the arrow adjacent the package P RPM up axis.

The controller 16 causes the cam motor 9 to rotatably drive the cam 8 at a rotational velocity related to the package P RPM $\omega_p$ detected by the package tachometer 7. In response to the rotation of the cam 8, the guide 13, and consequently the length of the material M received through the slot 14, reciprocatingly traverses between ends of the package P while the length of the material M is wrapped therearound. Traversing the length of material M between the ends of the package P while wrapping the length of material M therearound results in a helix angle 17 between a lengthwise axis of the length of material M during winding thereof on the package P and a plane 18 perpendicular to the lengthwise axis 6 of the package P. By controlling the frequency of reciprocating traversal of the guide 13 as a function of the package P RPM $\omega_p$, the spacing between centers of adjacent wraps of the length of material M on the package P is precisely controlled.

In accordance with the present invention, the controller 16 utilizing equation 2 produces the package P having constant spacing between adjacent wraps of the length of material M substantially throughout the package P. The spacing between adjacent wraps may be different when the controller 16 causes the traverse frequency to step increase (described hereinafter). However, these steps are relatively quick and therefore only briefly effect the consistency of spacing between adjacent wraps.

Figure 2:
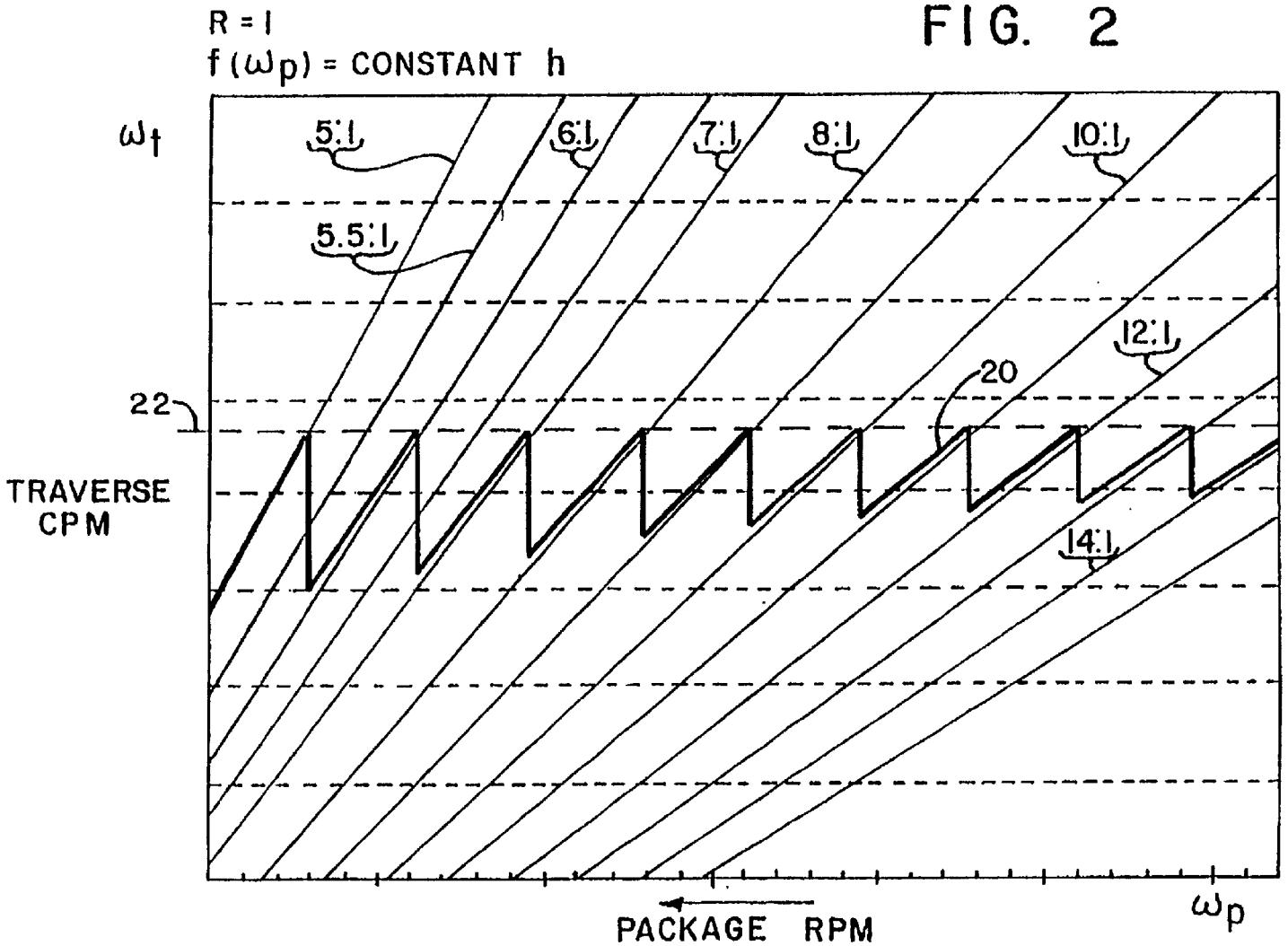
FIG. 2 shows a step precision winding curve having integer steps of actual winding ratio and having peaks in traverse frequency that are constant with decreasing package RPM.

With reference to FIG. 2 and with ongoing reference to FIG. 1 in accordance with the present invention, the controller 16 utilizing the following equation 2, having R=1 and $f(\omega_p)$="h", winds a package P in the manner shown by winding curve 20:

$$\omega_t=\frac{R\omega_p}{(1-aF)(1+\text{INT}(R\omega_p/f(\omega_p)))} \tag{2}$$

where $\omega_t$=traverse frequency;

$\omega_p$=package P RPM;

$\text{INT}(R\omega_p/f(\omega_p))$=integer part of $(R\omega_p/f(\omega_p))$;

R=integer number of step increases in the traverse frequency $\omega_t$ between integer winding ratios;

$F=1-\text{DEC}(1+\text{INT}(R\omega_p/f(\omega_p)))$, where DEC is the decimal part of $(1+\text{INT}(R\omega_p/f(\omega_p))$;

a=G/2k where:

G=desired spacing between centers of adjacent wraps of the length of material on the package P; and k=theoretical traverse distance of guide 13 between ends of the cam 8;

and $f(\omega_p)$=one of:

(i) h=constant;

EQ 3:

(ii) $(\omega_p+e)$; and

EQ 4:

(iii) $(\omega_t\ \text{final}+bx+cx^d)$, where:

b=maximum peak traverse frequency of guide 13;

$c=b-(\omega_t\text{start}-\text{final})$;

d=determines where the peak value of $\omega_t$ occurs with respect to the package P RPM $\omega_p$;

e=a constant; and $x=(\omega_p-\omega_p\ \text{min})/(\omega_p\text{max}-\omega_p\text{min})$.

Specifically, the controller 16 utilizing equation 2 winds the package P so that the traverse frequency $\omega_t$ is adjusted as a function of the package RPM $\omega_p$ whereby between step increase of the traverse frequency (described hereinafter), the ratio of the actual winding ratio to an integer winding ratio closely adjacent the actual winding ratio is constant throughout the winding of the package P.

It has been observed that wrapping the length of material M around the package P at integer winding ratios, e.g., 4:1, 5:1, etc. or sub-integer winding ratios e.g., 5:4, 4:3, 5:3, 7:4, 9:4, 7:3, etc., produces overlays of one wrap of the length of material M wholly or partially on top of an adjacent wrap in a narrow helical band thereby producing bumps in the package P. The overlay of one wrap of the length of material M wholly or partially on top of an adjacent wrap produces, during unwinding of the package P, non-uniform take-off tension of the length of material M. Moreover, the bumps in the package P produce vibration during rotation. To avoid or minimize the overlay of one wrap of the length of material M wholly or partially on top of an adjacent wrap, the controller 16, between steps in traverse frequency $\omega_t$ (described hereinafter), maintains the actual winding ratio closely adjacent an integer winding ratio or a sub-integer winding ratio, preferably, a half-integer winding ratio during winding of the package P.

Specifically, as shown by the winding curve 20, the controller 16 decreases the traverse frequency $\omega_t$ with decreasing package P RPM $\omega_p$ whereby the actual winding ratio parallels closely adjacent an integer winding ratio, e.g., 12:1. When the package P RPM $\omega_p$ decreases to an extent determined by equation 2, the controller 16 causes the traverse frequency $\omega_t$ to step increase thereby causing the actual winding ratio to step decrease adjacent another integer winding ratio, specifically the next lower integer winding ratio, e.g., 11:1. Because the step increase in traverse frequency $\omega_t$ occurs rapidly, the actual winding ratio only corresponds momentarily to an integer winding ratio or a sub-integer winding ratio. Hence, the overlay of one wrap of the length of material M wholly or partially on top of an adjacent wrap is minimized When the constant "h" is utilized in equation 2 for the function $f(\omega_p)$, the controller 16 winds the package P in a manner whereby the peaks in traverse frequency 22 for each step increase in traverse frequency $\omega_t$ is constant as shown in FIG. 2. Hence, the constant "h" corresponds to the peak traverse frequency 22 in FIG. 2.

The controller 16, utilizing equation 2 having R=1, winds the package P in a manner whereby, between step increase in traverse frequency, the ratio of the actual winding ratio to the integer winding ratio closely adjacent the actual winding ratio is constant. More specifically, the controller 16 controls the traverse frequency $\omega_t$ it in a manner whereby the ratio of the actual winding ratio to integer winding ratio closely adjacent thereto, hereinafter the "integer offset ratio" is constant regardless of which integer winding ratio the actual winding ratio is adjacent. For example, the ratio of the actual winding ratio to the 12:1 integer winding ratio, when the actual winding ratio is closely adjacent the 12:1 integer winding ratio. is the same as the ratio of the actual winding ratio to the 6:1 integer winding ratio when the actual winding ratio is closely adjacent the 6:1 integer winding ratio.

Figure 3A:
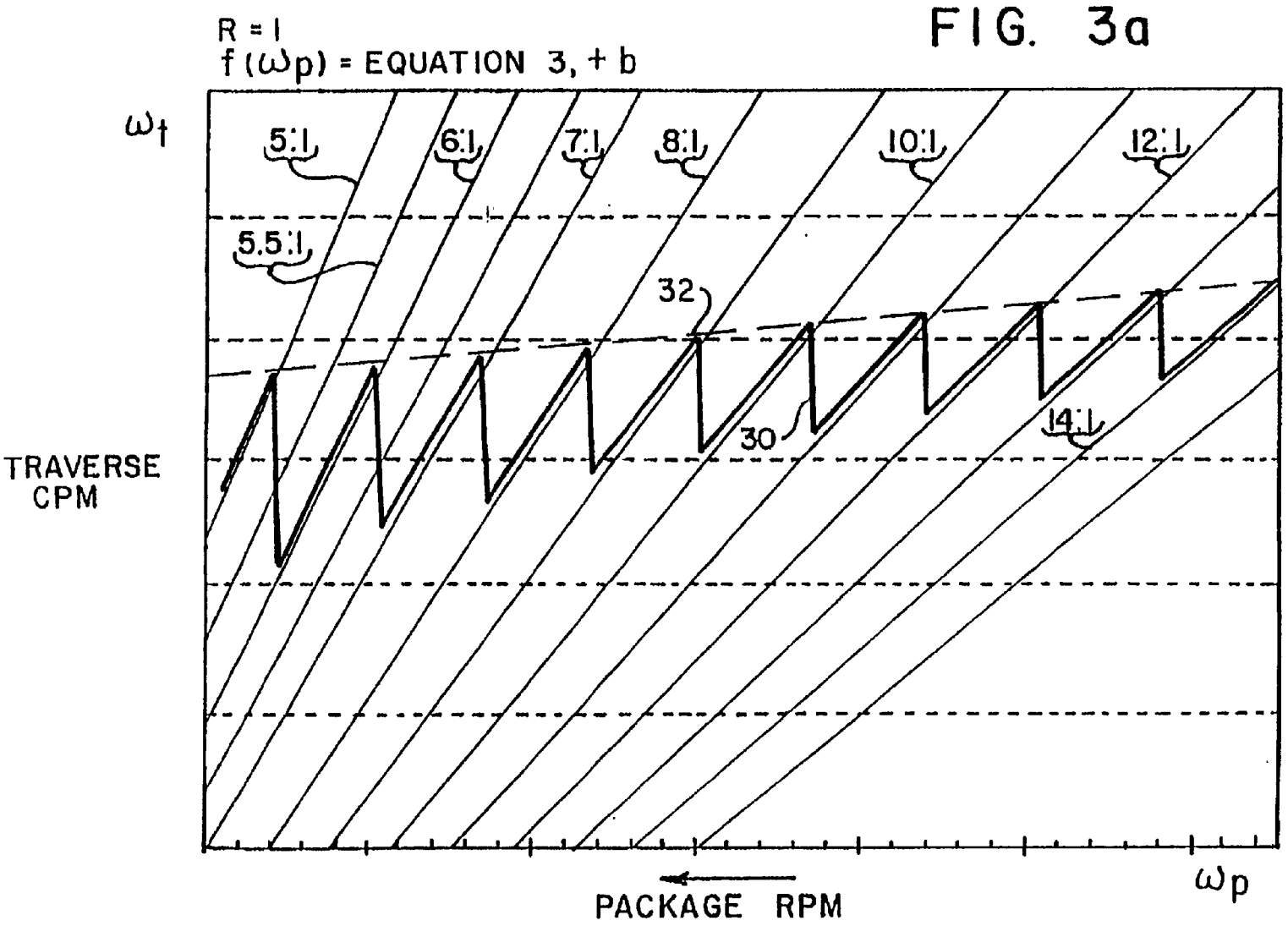
FIGS. 3*a* and 3*b* show step precision winding curves having integer steps of actual winding ratio and having peaks in traverse frequency that decrease and increase, respectively, with decreasing package RPM.
Figure 3B:
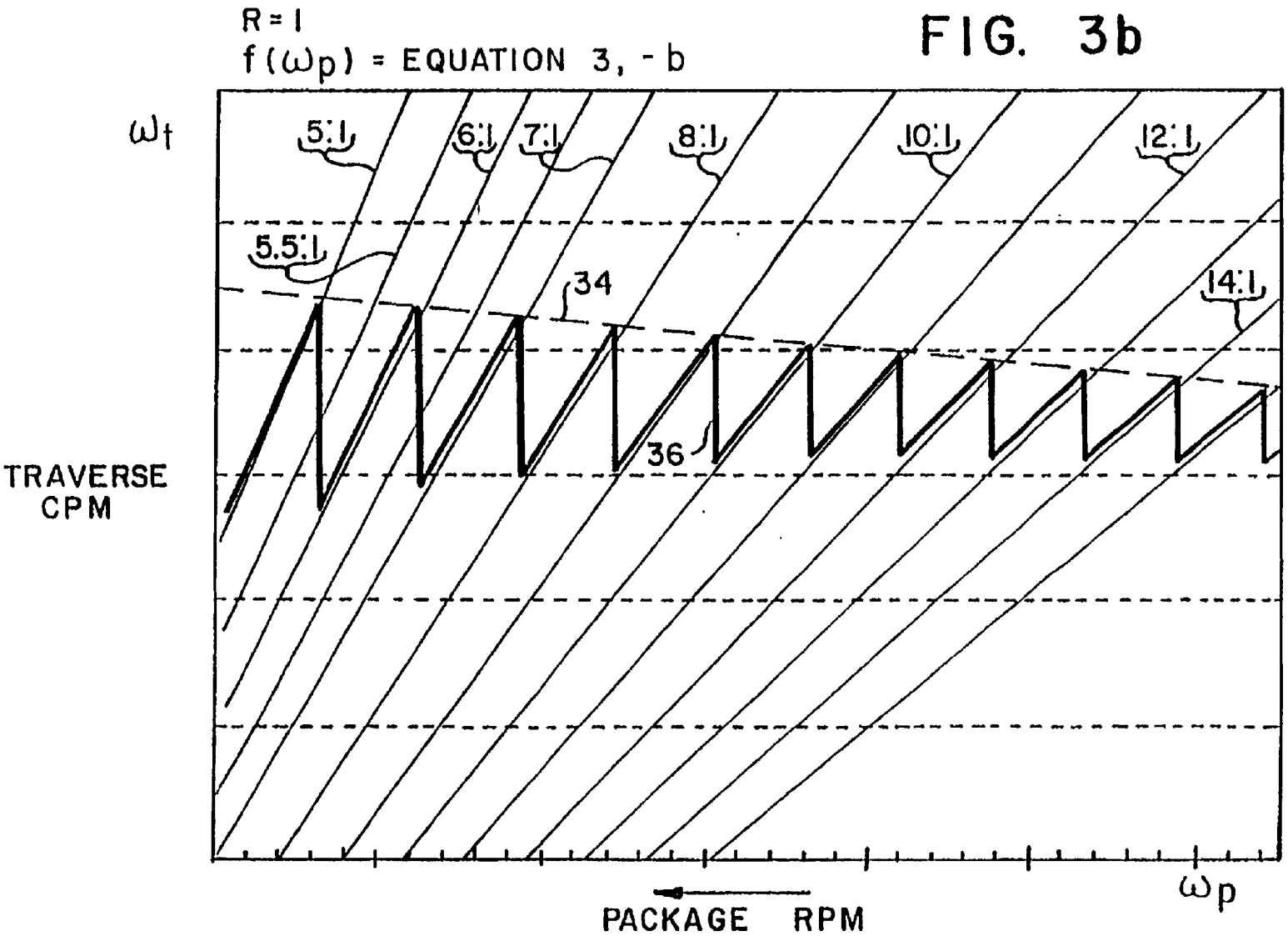

With reference to FIGS. 3*a* and 3*b*, the controller 16 utilizing equation 2, having R=1 and $f(\omega_p)$=equation 3, winds the package P in the manner shown by winding curve 30. Specifically, the controller 16 decreases the traverse frequency $\omega_t$ with decreasing package P RPM $\omega_p$ whereby the actual winding ratio parallels closely adjacent an integer winding ratio, e.g., 14:1, at the integer offset ratio. When the package RPM $\omega_p$ decreases to an extent determined by equation 2, the controller 16 causes the traverse frequency $\omega_t$ to step increase thereby causing the actual winding ratio to step decrease adjacent the next lower integer winding ratio, e.g., 13:1, at the integer offset ratio.

As shown in FIG. 3*a*, the peaks in traverse frequency $\omega_t$ decrease with each step increase thereof. Connecting with dashed line 32 the peaks of each step increase in the traverse frequency $\omega_t$ illustrate that the peaks in traverse frequency decrease uniformly with decreasing package P RPM $\omega_p$. The rate of decrease. or slope, of dashed line 32 is adjusted by selection of the magnitude for the constant "b" in equation 3. Moreover, by appropriate selection of the symbol, i.e., + or −, for the constant "b" in equation 3, the slope of a line connecting the peaks in traverse frequency $\omega_t$, for each step increase thereof, can be made positive, as shown by dashed line 32 in FIG. 3*a*, or negative, as shown by dashed line 34 extending between the peaks of each step increase in the traverse frequency $\omega_t$ of the winding curve 36 in FIG. 3*b*. Hence, for a negative value of "b" in equation 3, the controller 16 causes the peaks in traverse frequency $\omega_t$ to increase with each step increase thereof during winding.

Figure 4:
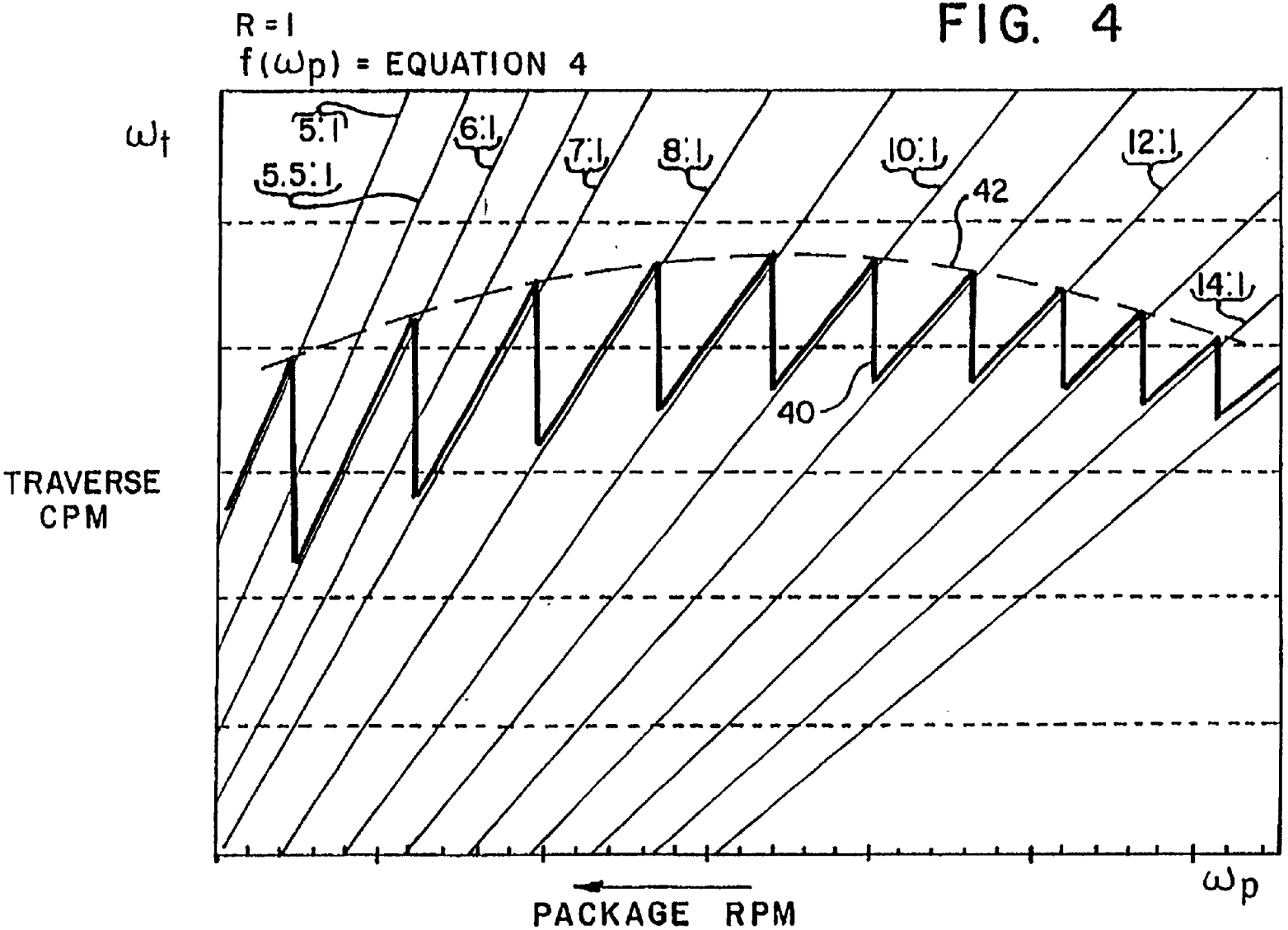
FIG. 4 shows a step precision winding curve having integer steps of actual winding ratio and having peaks in traverse frequency that increase and then decrease with decreasing package RPM.

With reference to FIG. 4, the controller 16 utilizing equation 2 having R=1 and $f(\omega_p)$=equation 4, winds the package P in the manner shown by winding curve 40. Specifically, the controller 16 decreases the traverse frequency $\omega_t$ with decreasing package P RPM $\omega_p$ so that the actual winding ratio parallels closely adjacent an integer winding ratio, e.g. 12:1, at the integer offset ratio. When the package P RPM $\omega_p$ decreases to an extent determined by equation 2, the controller 16 causes the traverse frequency $\omega_t$ to step increase thereby causing the actual winding ratio to step decrease adjacent the next lower integer winding ratio, e.g., 11:1, at the integer offset ratio. The controller 16 controls the traverse frequency $\omega_t$ so that the actual integer winding ratio parallels closely adjacent an integer winding ratio, at the integer offset ratio, between step increases of the traverse frequency $\omega_t$. In contrast to winding curves 20, 30 and 36, however, the peaks in traverse frequency $\omega_t$ for each step increase thereof initially increase to a maximum peak traverse frequency and thereafter decrease, as shown by dashed curve 42 which connects the peaks in traverse frequency for each step increase thereof in the winding curve 40.

For example, if winding of the package P begins at an actual winding ratio that is closely adjacent the 14:1 integer winding ratio, the controller 16 causes the traverse frequency $\omega_t$ to decrease with decreasing package P RPM $\omega_p$ so that the actual winding ratio parallels closely adjacent the 14:1 integer winding ratio at the integer offset ratio. When the package P RPM $\omega_p$ decreases to an extent determined by equation 2, the traverse frequency $\omega_t$ is step increased whereby the actual winding ratio step decreases from adjacent the 14:1 integer winding ratio to adjacent the 13:1 integer winding ratio, at the integer offset ratio. As shown in FIG. 4, however, the peak traverse frequency of the actual winding ratio adjacent the 13:1 integer winding ratio is greater than the peak traverse frequency of the actual winding ratio adjacent the 14:1 integer winding ratio. The increase in peak traverse frequency $\omega_t$ for each step decrease in actual winding ratio continues until a maximum peak traverse frequency $\omega_t$ is attained, in this example, for the actual winding ratio closely adjacent the 9:1 integer winding ratio. Thereafter, as the package P RPM $\omega_p$ decreases in response to ongoing winding of the package P, the peak traverse frequency $\omega_t$ decreases with each step decrease in actual winding ratio until the winding of the package P is complete.

Figure 5:
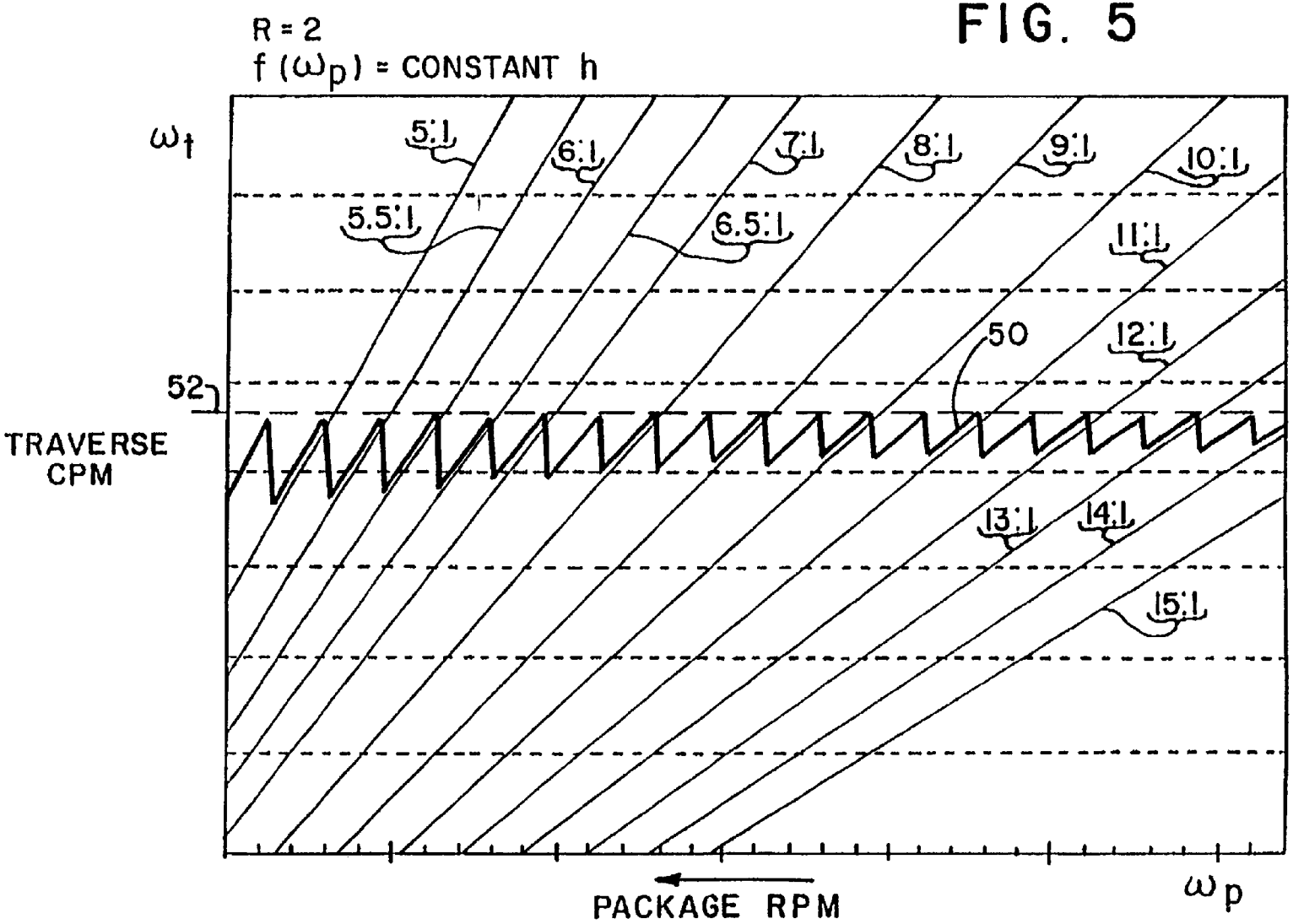
FIG. 5 shows a step precision winding curve having half-integer steps of actual winding ratio and having peaks in traverse frequency that are constant with decreasing package RPM.

With reference to FIG. 5, as noted above, winding the package P at sub-integer winding ratios produces overlay of one wrap of the length of material M wholly or partially on top of an adjacent wrap in a narrow helical band of the package P, albeit to a lesser extent than winding the package P at an integer winding ratio. To avoid overlay of one wrap of the length of material M wholly or partially on top of an adjacent wrap, the controller 16 operating in accordance with equation 2 having R=2 and $f(\omega_p)$="h", winds a package P in the manner shown by winding curve 50. Specifically, the controller 16 step increases the traverse frequency $\omega_t$ whereby the actual winding ratio step decreases between adjacent an integer winding ratio and adjacent a sub-integer winding ratio, preferably adjacent a half-integer winding ratio, or vice versa.

For example, if the package P is being wound at an actual winding ratio adjacent the 6:1 integer winding ratio, the controller 16 causes the actual winding ratio to decrease with decreasing package P RPM $\omega_p$ so that the actual winding ratio parallels closely adjacent the 6:1 integer winding, ratio at the integer offset ratio. When the package P RPM $\omega_p$ decreases to an extent determined by equation 2, the controller 16 causes the traverse frequency $\omega_t$ to step increase whereby the actual winding ratio step decreases adjacent the 5.5:1 half-integer winding ratio.

The controller 16 utilizing equation 2 having R=2, winds the package P in a manner whereby a ratio of the actual winding ratio to the sub-integer winding ratio closely adjacent the actual winding ratio is constant during winding of the package. More specifically, the controller 16 controls the traverse frequency $\omega_t$ in a manner whereby the ratio of the actual winding ratio to sub-integer winding ratio closely adjacent thereto, hereinafter the "sub-integer offset ratio", is constant regardless of which sub-integer winding ratio the actual winding ratio is adjacent. For example, the sub-integer offset ratio of the actual winding ratio adjacent the 11.5:1 half-integer winding ratio is the same as the sub-integer offset ratio of the actual winding ratio adjacent the 5.5:1 half-integer winding ratio.

With ongoing winding, the controller 16 causes the traverse frequency $\omega_t$ to decrease with decreasing package P RPM $\omega_p$ so that the actual winding ratio parallels closely adjacent the 5.5:1 half-integer winding ratio at the sub-integer offset ratio. When the package P RPM $\omega_p$ decreases to an extent determined by equation 2, the controller 16 causes the traverse frequency $\omega_t$ to step increase whereby the actual winding ratio step decreases adjacent the 5:1 integer winding ratio at the integer offset ratio. The winding of the package P continues in this manner until the package P is wound to a desired extent.

Like the winding curve 20 shown in FIG. 2, the controller 16, utilizing equation 2 having R=2 and f($\omega_p$)="h", winds the package P in the manner shown by the winding curve 50 whereby the peaks in traverse frequency $\omega_t$ for each step increase thereof are constant, as shown by dashed line 52 in FIG. 5.

As described above, the controller 16 controls the traverse frequency $\omega_t$ in a manner whereby the sub-integer winding ratio is constant regardless of which sub-integer winding ratio of the actual winding ratio is adjacent. Moreover, the controller 16 controls the traverse frequency $\omega_t$ in a manner whereby the integer offset ratio is constant regardless of which integer winding ratio the actual winding ratio is adjacent. Importantly, to maintain uniform thread line spacing, the sub-integer offset ratio and the integer offset ratio are different, as shown in FIG. 5.

Figure 6A:
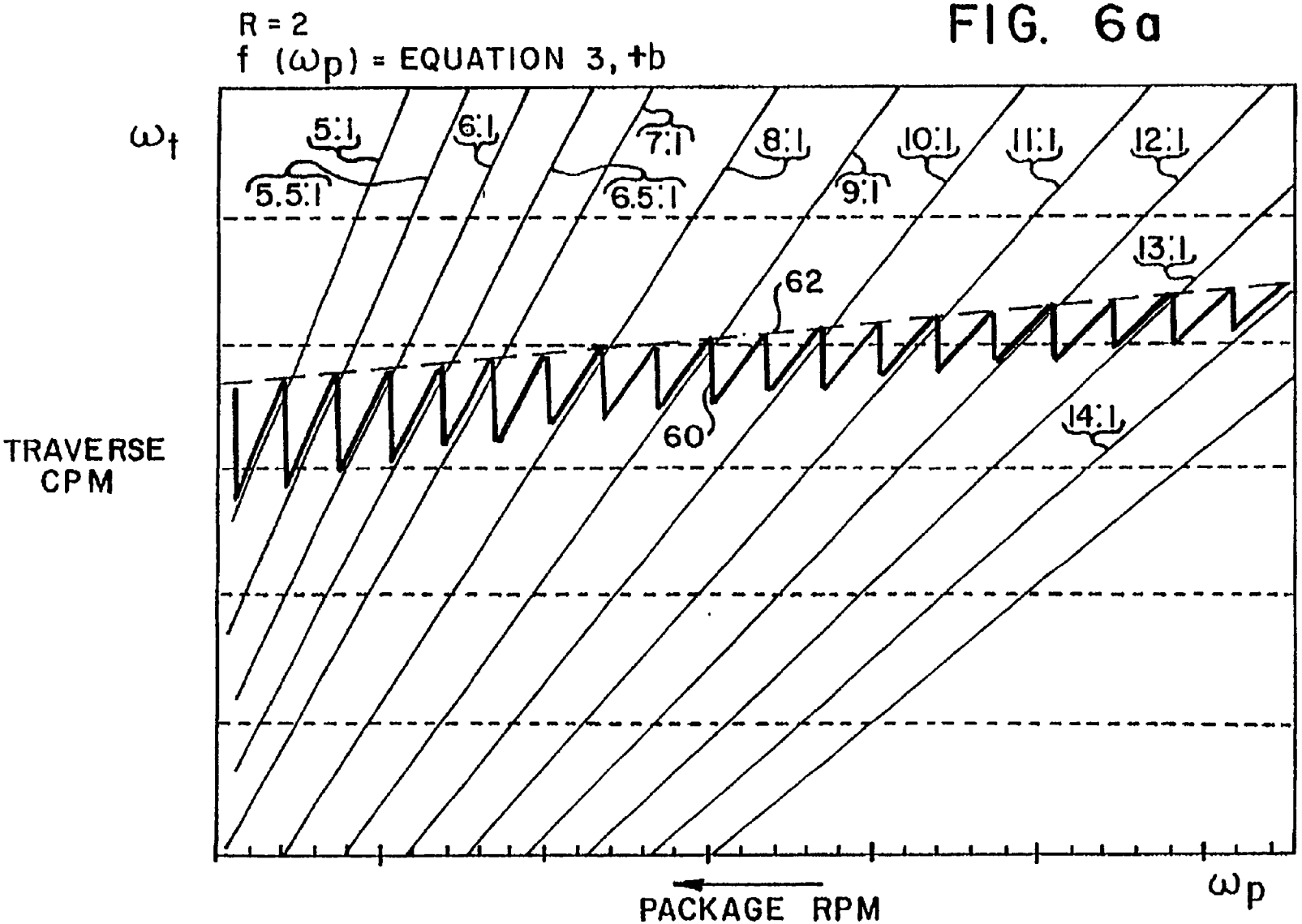
FIGS. 6*a* and 6*b* show step precision winding curves having half-integer steps of actual winding ratio and having peaks in traverse frequency that decrease and increase respectively, with decreasing package RPM.
Figure 6B:
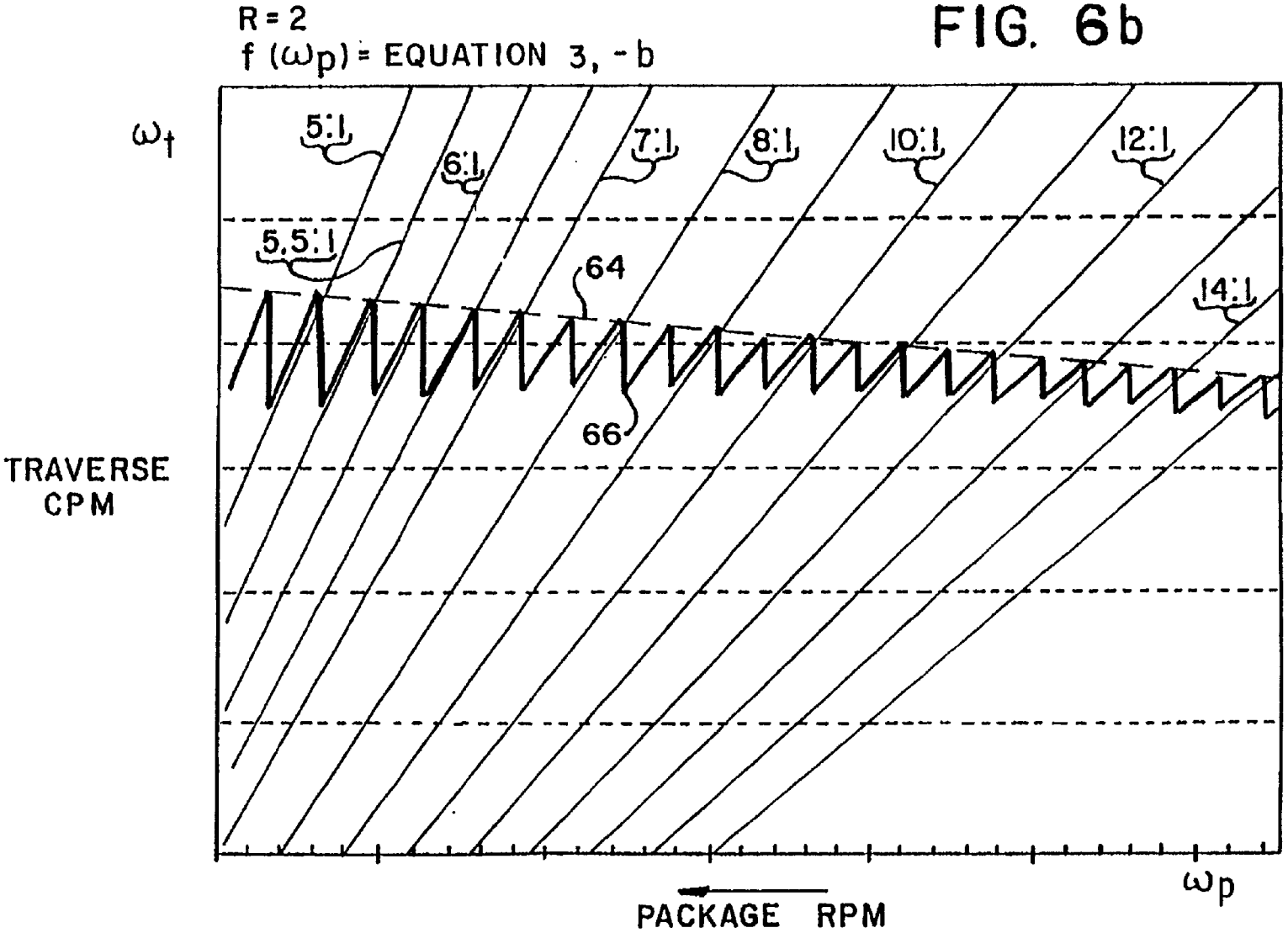

With reference to FIGS. 6*a* and 6*b*, the controller 16, utilizing equation 2 having R=2 and f($\omega_p$)=equation 3, winds the package P in the manner shown by winding curve 60. Specifically, the controller 16 decreases the traverse frequency $\omega_t$ with decreasing package P RPM $\omega_p$ so that the actual winding ratio parallels closely adjacent an integer winding ratio. e.g., 12:1, at the integer offset ratio. When the package P RPM $\omega_p$ cp decreases to an extent determined by equation 2, the traverse frequency $\omega_t$ is step increased thereby causing the actual winding ratio to step decrease adjacent the next lower sub-integer winding ratio, e.g., 11.5:1, at the sub-integer offset ratio.

With ongoing winding, the controller 16 causes the traverse frequency $\omega_t$ to decrease with decreasing package P RPM $\omega_p$ so that the actual winding ratio parallels closely adjacent the sub-integer winding ratio, e.g., 11.5:1, at the sub-integer offset ratio. When the package P RPM $\omega_p$ decreases to an extent determined by equation 2, the controller 16 causes the traverse frequency $\omega_t$ to step increase whereby the actual winding ratio step decreases adjacent the next lower integer winding ratio. e.g., 10:1, at the integer offset ratio. As shown by the winding curve 60, the peaks in traverse frequency $\omega_t$ for each step decrease in actual winding ratio decrease with decreasing package P RPM $\omega_p$, as shown by dashed line 62. In contrast to winding curve 30, however, the controller 16 utilizing equation 2 having R=2 and f($\omega_p$)=equation 3, causes the traverse frequency $\omega_t$ to step increase in a manner whereby the actual winding ratio step deceases between adjacent an integer winding ratio at an integer offset ratio and adjacent a sub-integer winding ratio, preferably a half-integer winding ratio, at a sub-integer offset ratio, or vice versa.

As shown in FIG. 6*a*, the peaks in traverse frequency decrease with each step increase thereof. Connecting with the dashed line 62, the peaks of each step increase in the traverse frequency $\omega_t$ illustrate that the peaks in traverse frequency decrease uniformly with decreasing package P RPM $\omega_p$. The rate of decrease, or slope, of dashed line 62, is adjusted by selection of the magnitude for the constant "b" in equation 3. Moreover, by appropriate selection of the symbol, i.e., + or −, for the constant "b" in equation 3, the slope of a line connecting the peaks in traverse frequency $\omega_t$ can be made positive, as shown by dashed line 62 in FIG. 6*a*, or negative as shown by the dashed line 64 extending between the peaks in traverse frequency $\omega_t$ of the winding curve 66 in FIG. 6*b*. Specifically, for a negative value of "b" in equation 3, the controller 16 causes the peaks in traverse frequency $\omega_t$ to increase with each step increase thereof during winding.

Figure 7:
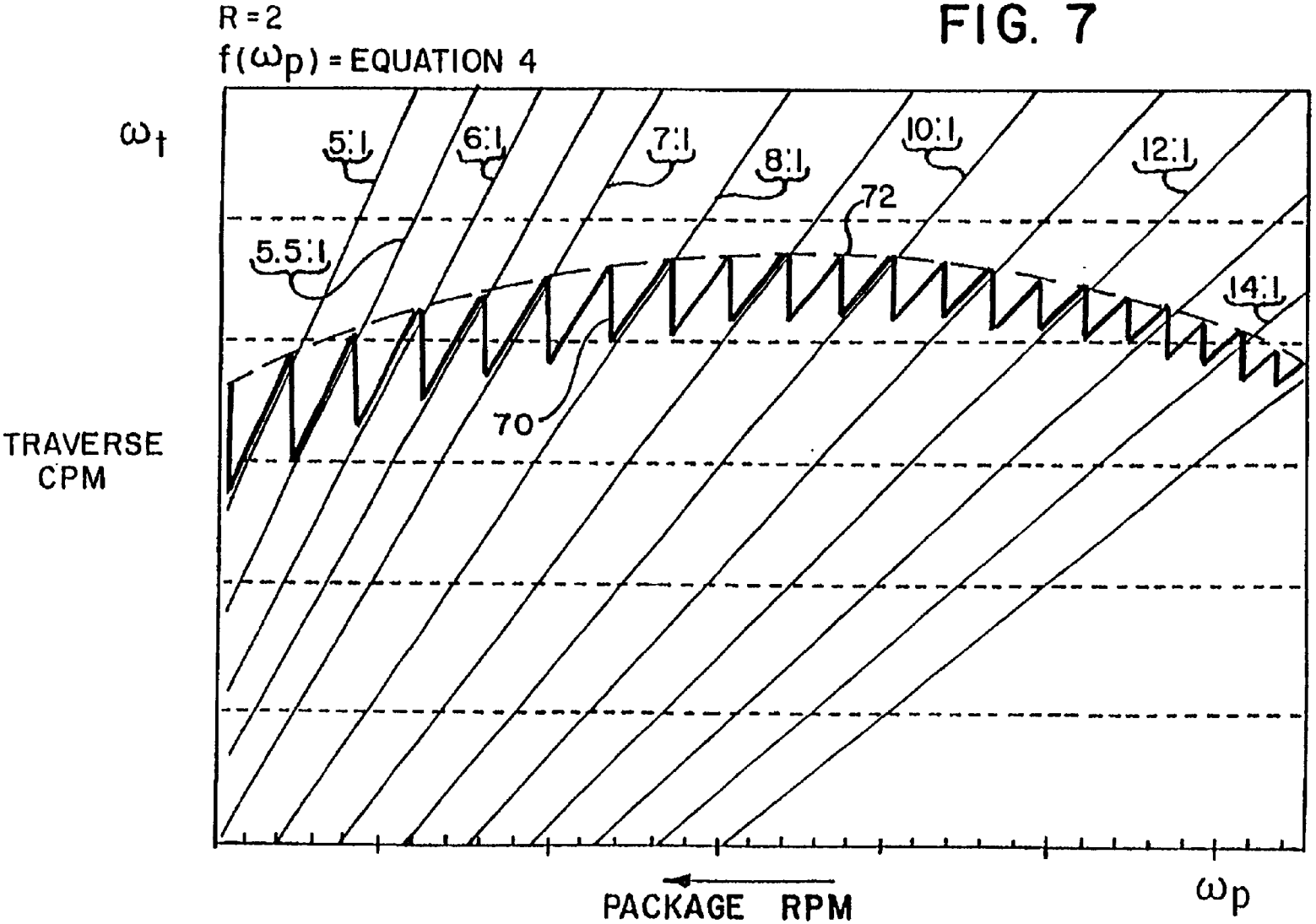
FIG. 7 shows a step precision winding curve having half-integer steps of actual winding ratio and having peaks in traverse frequency that initially increase and then decrease with decreasing package RPM.

With reference to FIG. 7, the controller 16 utilizing equation 2 having R=2 and f($\omega_p$)=equation 4, winds the package P in the manner shown by winding curve 70. Similar to the winding curve 40 in FIG. 4, the controller 16 decreases the traverse frequency $\omega_t$ at with decreasing package P RPM $\omega_p$ so that the actual winding ratio parallels closely adjacent an integer winding ratio, e.g., 12:1, at the integer offset ratio. When the package P RPM $\omega_p$ decreases to an extent determined by equation 2, the controller 16 causes the traverse frequency $\omega_t$ to step increase thereby causing the actual winding ratio to step decrease adjacent the next lower sub-integer winding ratio, preferably, a half-integer winding ratio, e.g., 11.5:1, at the sub-integer offset ratio. The controller 16 continues decreasing the traverse frequency with decreasing package P RPM $\omega_p$ so that the actual winding ratio parallels closely adjacent the sub-integer winding ratio, at the sub-integer offset ratio. When the package P RPM $\omega_p$ decreases to an extent determined by equation 2, the controller 16 causes the traverse frequency $\omega_t$ to step increase thereby causing the actual winding ratio to step decrease from adjacent the sub-integer winding ratio to adjacent the next lower integer winding ratio. e.g., 10:1, at the integer offset ratio. Like the winding curve 40 in FIG. 4, the peaks in traverse frequency $\omega_t$ for each step increase thereof initially increase to a maximum peak traverse frequency, e.g., adjacent the 9:1 integer winding ratio, and decrease thereafter, as shown by dashed curve 72.

In contrast to winding curve 40, however, the controller 16, utilizing equation 2 having R=2 and f($\omega_p$)=equation 4, causes the traverse frequency $\omega_t$ to step increase in a manner whereby the actual winding ratio step decreases between adjacent an integer winding ratio at the integer offset ratio and adjacent a sub-integer winding ratio, preferably, a half-integer winding ratio, at the sub-integer offset ratio, or vice versa.

From the foregoing, it can be seen that R=1 in equation 2 produces step decreases in actual winding ratio between adjacent one integer winding ratio at the integer offset ratio and adjacent another integer winding ratio, at the integer offset ratio. In contrast, it can be seen that R=2 in equation 2 produces steps in actual winding ratio between adjacent an integer winding ratio at the integer offset ratio and adjacent a sub-integer winding ratio at the sub-integer offset ratio, or vice versa. Integer values of R=3, 4, 5, etc., can be utilized in equation 2. However, it is believed that integer values of R greater than 2 do not improve the package P winding.

Moreover. from the foregoing. it can be seen the $f(\omega_p)=h$; equation 3; or equation 4, causes the peaks in traverse frequency for each step increase thereof to be constant with decreasing package P RPM $\omega_p$; decrease or increase with decreasing package P RPM $\omega_p$; or initially increase with decreasing package P RPM $\omega_p$ and then decrease with ongoing decrease of package P RPM $\omega_p$ respectively.

In equation 4, values for the constants "b" and "d" determine the shape of the dashed curves 42 and 72. Specifically, the variable "b" establishes the maximum peak in traverse frequency $\omega_t$ and the variable "d" establishes the package P RPM $\omega_p$ where the maximum peak in traverse frequency $\omega_t$ occurs. Hence, by selection of desired values for "b" and "d", the shape of dashed curves 42 and 72 can be suitably adjusted.

In accordance with the present invention, the controller 16 utilizing equation 2 having R=1 winds the package P in a manner whereby the integer offset ratio is constant regardless of which integer winding ratio the actual winding ratio is adjacent. For example, if the controller 16 utilizing equation 2 having R=1 causes the package P to wind at an actual winding ratio of 11.9:1, which is closest adjacent the 12:1 integer winding ratio, the integer offset ratio is $$\frac{11.9:1}{12:1}$$

As the actual winding ratio decreases with decreasing package P RPM $\omega_p$, the controller 16 maintains as constant the integer offset ratio. Hence, for example, the actual winding ratio adjacent the 6:1 integer winding ratio, utilized to wind the package P, is $$\frac{11.9:1}{12:1}(6:1) = 5.95:1$$

Similarly, the controller 16 utilizing equation 2 having R=2 winds the package in a manner whereby a ratio of the actual winding ratio to an integer winding ratio adjacent thereto is the integer offset ratio and a ratio of the actual winding ratio to a sub-integer winding ratio adjacent thereto is the sub-integer offset ratio. Hence, for example, if the controller 16 utilizing equation 2 having R=2 causes the package P to wind at an actual winding ratio of 11.9:1, which closest adjacent to the 12:1 integer winding ratio, the integer offset ratio is $$\frac{11.9:1}{12:1}$$

When the actual winding ratio step decreases from the integer winding ratio to a sub-integer winding ratio, the controller 16 utilizing equation 2 having R=2 adjusts between the integer offset ratio and the sub-integer offset ratio. Hence, for example, if the controller 16 causes the package P to wind at an actual winding ratio of 11.4:1, which is closest adjacent the 11.5:1 sub-integer winding ratio the integer offset ratio is $$\frac{11.4:1}{11.5:1}$$

When the package P RPM $\omega_p$ decreases to an extent determined by equation 2, the traverse frequency $\omega_t$ is step increased thereby causing the actual winding ratio to step decrease from adjacent the 11:5.1 sub-integer winding ratio to adjacent the 11:1 integer winding ratio at the integer offset ratio. Hence, the controller 16 utilizing equation 2 having R=2 winds the package P in a manner whereby the integer offset ratio is constant regardless of which integer winding ratio the actual winding ratio is adjacent, and the sub-integer offset ratio is constant regardless of which sub-integer winding ratio the actual winding ratio is adjacent.

It has been observed that maintaining the integer and sub-integer offset ratios constant during winding of the package P, excluding step increases in traverse frequency, produces a package P winding having uniform spacing between centers of adjacent wraps of the length of material throughout the package P. Specifically, it has been observed that the difference between the integer offset ratio and the sub-integer offset ratio caused by the controller 16 utilizing equation 2 having R=2 produces a package P having uniform spacing between centers of adjacent wraps of the length of material throughout the package P. In contrast, it is believed that having an integer offset ratio that varies during the package P winding, a sub-integer offset ratio that varies during the package P winding or uncontrolled differences between the integer and sub-integer offset ratios during the package P winding, produces a package having variances in the spacing between centers of adjacent wraps of the length of material throughout the package P. Specifically, it is believed that the spacing between centers of adjacent wraps wound at different actual wining ratios will be different.

Referring back to FIG. 1, in equation 2 the constant "k" is related to a theoretical traverse distance of the guide 13. This theoretical traverse distance is determined by extending the curved ends 80, 82 of the groove 12 to imaginary points on opposite ends of the cam 8. The distance between the imaginary points is utilized as the constant "k" in determining the value for "a" to be utilized in equation 2.

Exemplary values for the constants in equation 2 for winding 1000 denier yarn at 2560 meters/minute, at a maximum helix angle of 7° include:

G=0.1 inch;

k=10.2 inch;

$$a = \frac{G}{2k} = 0.005 \text{ [dimensionless number]}; \quad \text{and}$$

$f(\omega_p)=h=4800$;

$f(\omega_p)=(b\omega_p+e)$, where:

b=0.02; and e=6400;

or $f(\omega_p)=(\omega_t final+bx+cx^d)$, where:

$\omega_t final=4800$;

b=2000;

c=−1900;

d=2; and $x=(\omega_p-2700)/6300$.

From the foregoing, it can be seen that the present invention provides a winding apparatus and method wherein each step decrease in actual winding ratio is equal to or less than one integer winding ratio. Moreover, except for step decreases in the actual winding ratio during winding of the package P, a constant integer offset ratio and/or a constant sub-integer offset ratio is maintained.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

We claim:

1. A method of winding a package, the method comprising the steps of:

(a) supplying a continuous length of material to a bobbin having a lengthwise axis;

(b) rotating the bobbin around the lengthwise axis;

(c) winding the supplied continuous length of material around the periphery of the rotating bobbin to form a package;

(d) traversing the supplied continuous length of material reciprocatingly between ends of the package while winding the same therearound;

(e) determining the rotational velocity of the rotating package while winding the length of material therearound;

(f) controlling a traverse frequency the supplied continuous length of material is reciprocatingly traversed between the ends of the package while winding the length of material therearound;

(g) winding the length of material on the package at a first actual winding ratio adjacent a first integer winding ratio;

(h) decreasing the traverse frequency in response to decreasing rotational velocity of the package whereby the first actual winding ratio parallels adjacent the first integer winding ratio; and (i) step increasing the traverse frequency whereby the first actual winding ratio step decreases to a second actual winding ratio adjacent a second integer winding ratio, wherein:

each actual winding ratio corresponds to a ratio of the determined rotational velocity of the package to the determined traverse frequency;

a ratio of the first actual winding ratio and the adjacent first integer winding ratio defines an integer offset ratio; and a ratio of the second actual winding ratio and the second integer winding ratio corresponds to the integer offset ratio.

2. The method as set forth in claim 1, further including the steps of:

winding before the first integer winding ratio the length of material on the package at an actual winding ratio adjacent a sub-integer winding ratio;

decreasing the traverse frequency in response to decreasing rotational velocity of the package whereby the actual winding ratio parallels adjacent the sub-integer winding ratio; and step increasing the traverse frequency whereby the actual winding ratio paralleling adjacent the sub-integer winding ratio step decreases to the first actual winding ratio, wherein:

a ratio of the actual winding ratio and the sub-integer winding ratio adjacent thereto defines a sub-integer offset ratio; and the integer offset ratio and the sub-integer offset ratio are different.

3. The method as set forth in claim 2, wherein the sub-integer winding ratio is a half-integer winding ratio.

4. The method as set forth in claim 1, further including the step of:

decreasing the traverse frequency in response to decreasing rotational velocity of the package whereby the second actual winding ratio parallels adjacent the second integer winding ratio at the integer offset ratio.

5. The method as set forth in claim 1, further including the steps of:

step increasing the traverse frequency whereby the first actual winding ratio step decreases to an actual winding ratio adjacent a sub-integer winding ratio between the first integer winding ratio and the second integer winding ratio;

decreasing the traverse frequency in response to decreasing rotational velocity of the package whereby the actual winding ratio parallels adjacent the sub-integer winding ratio; and step increasing the traverse frequency whereby the actual winding ratio paralleling adjacent the sub-integer winding ratio step decreases to the second integer winding ratio, wherein:

a ratio of the actual winding ratio and the sub-integer winding ratio adjacent thereto defines a sub-integer offset ratio.

6. The method as set forth in claim 1, wherein with decreasing rotational velocity of the package the integer offset ratio is constant for each actual winding ratio that parallels adjacent an integer winding ratio and the sub-integer offset ratio is constant for each actual winding ratio that parallels adjacent a sub-integer winding ratio.

7. The method as set forth in claim 1, wherein the decrease in traverse frequency and the step increase in traverse frequency are controlled as a function of the equation $$\omega_t = \frac{R\omega_p}{(1 - aF)(1 + \mathrm{INT}(R\omega_p / f(\omega_p)))}$$

where $\omega_t$=traverse frequency;

$\omega_p$=rotational velocity of package;

$\mathrm{INT}(R\omega_p/f(\omega_p))$=integer part of $(R\omega_p/f(\omega_p))$;

R=integer number of step increases in the traverse frequency $\omega_t$ between integer winding ratios;

$F=1-\mathrm{DEC}(1+\mathrm{INT}(R\omega_p/f(\omega_p)))$, where DEC is the decimal part of $(1+\mathrm{INT}(R\omega_p/f(\omega_p)))$;

a=G/2 k where

G=desired spacing between centers of adjacent wraps of the length of material on the package;

k=theoretical traverse distance of length of material on the package; and $f(\omega_p)$=one of:

(i) h=a constant;

(ii) $(b\omega_p+e)$; and (iii) $(\omega_t\mathrm{final}+bx+cx^d)$, where b=maximum traverse frequency;

$c=b-(\omega_t\mathrm{start}-\omega_t\mathrm{final})$;

d=determines where the peak value of $\omega_t$ occurs with respect to package P RPM $\omega_p$;

e=a constant; and $x=(\omega_p-\omega_p\mathrm{min})/(\omega_p\mathrm{max}-\omega_p\mathrm{min})$.

8. A winding apparatus for winding a length of material, the apparatus comprising:

a package drive connected to rotatably drive around a lengthwise axis a package positioned to receive a length of material therearound;

a cam positioned adjacent the package;

a cam drive connected to rotatably drive the cam, the cam drive and cam coacting to reciprocatingly traverse the length of material between ends of the package when receiving the length of material therearound;

a package tachometer which detects the rotational velocity of the package in response to being driven around the lengthwise axis and which provides an output sign indicative thereof; and a controller having an input connected to receive the output signal from the package tachometer and which has an output connected to an input of the cam drive for controlling the rotational velocity thereof whereby the traverse frequency of the length of material between the ends of the package is controlled as a function of the rotational velocity of the package, wherein:

the length of material is wound on the package at a first actual winding ratio adjacent a first integer winding ratio;

the traverse frequency is decreased in response to decreasing rotational velocity of the package whereby the first actual winding ratio parallels adjacent the first integer winding ratio;

the traverse frequency is step increased whereby the first actual winding ratio step decreases to a second actual winding ratio adjacent a second integer winding ratio;

each actual winding ratio corresponds to a ratio of the detected rotational velocity of the package to the detected rotational velocity of the cam;

a ratio of the first actual winding ratio and the adjacent first integer winding ratio defines an integer offset ratio; and a ratio of the second actual winding ratio and the second integer winding ratio corresponds to the integer offset ratio.

9. The winding apparatus as set forth in claim 8, wherein:

the rotational velocity of the cam drive is controlled so that between step increases in the traverse frequency the actual winding ratio avoids integer winding ratios; and during step increases in the traverse frequency, the actual winding ratio momentarily corresponds to an integer winding ratio.

10. The winding apparatus as set forth in claim 8, further including a guide connected to the cam which reciprocatingly moves the guide between the ends of the package, wherein:

the guide directs the length of material to the package; and the guide and cam cooperate to cause the length of material to reciprocatingly traverse between ends of the package when the package receives the length of material therearound.

11. The winding apparatus as set forth in claim 10, wherein:

the guide includes a slot positioned at an end of the guide opposite the cam; and the slot receives the length of material therethrough.

12. The winding apparatus as set forth in claim 8, wherein the traverse frequency of the length of material between the ends of the package is controlled as a function of the equation $$\omega_t = \frac{R\omega_p}{(1 - aF)(1 + \mathrm{INT}(R\omega_p / f(\omega_p)))}$$

where $\omega_t$=traverse frequency;

$\omega_p$=rotational velocity of package;

$\mathrm{INT}(R\omega_p/f(\omega_p))$=integer part of $(R\omega_p/f(\omega_p))$;

R=integer number of step increases in the traverse frequency $\omega_t$ between integer winding ratios;

$F=1-\mathrm{DEC}(1+\mathrm{INT}(R\omega_p/f(\omega_p)))$, where DEC is the decimal part of $(1+\mathrm{INT}(R\omega_p/f(\omega_p)))$;

a=G/2 k where

G=desired spacing between centers of adjacent wraps of the length of material on the package;

k=theoretical traverse distance of length of material on the package; and $f(\omega_p)$=one of:

(i) h=a constant;

(ii) $(b\omega_p+e)$; and (iii) $(\omega_t\mathrm{final}+bx+cx^d)$, where b=maximum traverse frequency;

$c=b-(\omega_t\mathrm{start}-\omega_t\mathrm{final})$;

d=determines where the peak value of $\omega_t$ occurs with respect to the package P RPM $\omega_p$;

e=a constant; and $x=(\omega_p-\omega_p\mathrm{min})/(\omega_p\mathrm{max}-\omega_p\mathrm{min})$.

13. The winding apparatus as set forth in claim 8, wherein:

before winding the length of material on the package at the first integer winding ratio, the length of material is wound on the package at an actual winding ratio adjacent a sub-integer winding ratio;

in response to decreasing rotational velocity of the package as the length of material is wound thereon, the traverse frequency is decreased whereby the actual winding ratio parallels adjacent the sub-integer winding ratio;

the traverse frequency is step increased whereby the actual winding ratio paralleling adjacent the sub-integer winding ratio step decreases to the first actual winding ratio;

a ratio of the actual winding ratio and the sub-integer winding ratio adjacent thereto defines a sub-integer offset ratio; and the integer offset ratio and the sub-integer offset ratio are different.

14. The winding apparatus as set forth in claim 8, wherein:

the traverse frequency is decreased in response to decreasing rotational velocity of the package whereby the second actual winding ratio parallels adjacent the second integer winding ratio at the integer offset ratio.

15. The winding apparatus as set forth in claim 8, wherein:

the traverse frequency is step increased whereby the first actual winding ratio step decreases to an actual winding ratio adjacent a sub-integer winding ratio between the first integer winding ratio and the second integer winding ratio;

in response to decreasing rotational velocity of the package as the length of material is wound thereon, the traverse frequency is decreased whereby the actual winding ratio parallels adjacent the sub-integer winding ratio;

the traverse frequency is step increased whereby the actual winding ratio paralleling adjacent the sub-integer winding ratio step decreases to the second actual winding ratio; and a ratio of the actual winding ratio and the sub-integer winding ratio adjacent thereto defines to a sub-integer offset ratio.

16. A method of winding a length of material on a package, the method comprising the steps of:

(a) rotating a package around a lengthwise axis thereof;

(b) wrapping a continuous length of material around the rotating package;

(c) determining an RPM of the rotating package;

(d) traversing between ends of the package the length of material during the wrapping thereof around the rotating package;

(e) controlling the traverse frequency to wind the package at a first actual winding ratio adjacent a first integer winding ratio:

(f) decreasing the traverse frequency in response to decreasing package RPM whereby the first actual winding ratio parallels adjacent the first integer winding ratio, the package RPM decreasing in response to winding the length of material on the package; and (g) step increasing the traverse frequency whereby the first actual winding ratio step decreases to a second actual winding ratio adjacent a second integer winding ratio, wherein:

each actual winding ratio corresponds to a ratio of the package RPM to the traverse frequency;

a ratio of the first actual winding ratio and the adjacent first integer winding ratio defines an integer offset ratio; and a ratio of the second actual winding ratio and the second integer winding ratio corresponds to the integer offset ratio.

17. The method as set forth in claim 16, wherein for each step decrease in actual winding ratio with decreasing package RPM, the peak traverse frequency one of:

(i) remains constant;

(ii) increases;

(iii) decreases; and (iv) increases to a maximum traverse frequency and decreases thereafter.

18. The method as set forth in claim 16, further including the steps of:

step increasing the traverse frequency whereby the first actual winding ratio step decreases to an actual winding ratio adjacent a sub-integer winding ratio between the first integer winding ratio and the second integer winding ratio;

decreasing the traverse frequency in response to decreasing package RPM whereby the actual winding ratio parallels the sub-integer winding ratio adjacent thereto; and step increasing the traverse frequency whereby the actual winding ratio step decreases to the second actual winding ratio, wherein:

a ratio of the actual winding ratio and the sub-integer winding ratio adjacent thereto defines a sub-integer offset ratio.

19. A method of winding a length of material on a package, the method comprising the steps of:

(a) rotating a package around a lengthwise axis thereof;

(b) wrapping a continuous length of material around the rotating package;

(c) determining an RPM of the rotating package;

(d) traversing between ends of the package the length of material during the wrapping thereof around the rotating package;

(e) controlling the traverse frequency to wind the package at a first actual winding ratio adjacent a sub-integer winding ratio;

(f) decreasing the traverse frequency in response to decreasing package RPM whereby the first actual winding ratio parallels adjacent the sub-integer winding ratio, the package RPM decreasing in response to winding the length of material on the package; and (g) step increasing the traverse frequency whereby the actual winding ratio step decreases to a second actual winding ratio adjacent an integer winding ratio, wherein:

each actual winding ratio corresponds to a ratio of the package RPM to the traverse frequency;

a ratio of the first actual winding ratio and the sub-integer winding ratio adjacent thereto defines a sub-integer offset ratio that is constant throughout the winding of the package for each actual winding ratio adjacent a sub-integer winding ratio; and a ratio of the second actual winding ratio and the integer winding ratio adjacent thereto defines an integer offset ratio that is constant throughout the winding of the package for each actual winding ratio adjacent an integer winding ratio.

20. The method as set forth in claim 19, further including the steps of:

step increasing the traverse frequency whereby the second actual winding ratio step decreases to a third actual winding ratio adjacent an other sub-integer winding ratio;

decreasing the traverse frequency in response to decreasing package RPM whereby the third actual winding ratio parallels the other sub-integer winding ratio; and step increasing the traverse frequency whereby the actual winding ratio step decreases to a fourth actual winding ratio adjacent an other integer winding ratio, wherein:

a ratio of the third actual winding ratio and the other sub-integer winding ratio adjacent thereto corresponds to the sub-integer offset ratio; and a ratio of the fourth actual winding ratio and the other integer winding ratio adjacent thereto corresponds to the integer offset ratio.

* * * * *